United States Patent [19]

Matsuura et al.

[11] Patent Number: 4,881,498

[45] Date of Patent: Nov. 21, 1989

[54] ROCKER ARM MADE OF CERAMICS

[75] Inventors: Tooru Matsuura; Yoshinori Narita, both of Aichi, Japan

[73] Assignee: NGK Spark Plug Co., Ltd., Nagoya, Japan

[21] Appl. No.: 317,999

[22] Filed: Mar. 2, 1989

[30] Foreign Application Priority Data

Mar. 5, 1988 [JP] Japan ..... 63-28700[U]

[51] Int. Cl.[4] ..... F01L 1/18

[52] U.S. Cl. ..... 123/90.39; 123/90.44; 123/90.51

[58] Field of Search ..... 123/90.39, 90.41, 90.44, 123/90.47, 90.51

[56] References Cited

U.S. PATENT DOCUMENTS 4,583,502 4/1986 Takahashi et al. ..... 123/90.39

4,796,576 1/1989 Matsuura et al. ..... 123/90.44

*Primary Examiner*—Charles J. Myhre

*Assistant Examiner*—Weilun Lo

*Attorney, Agent, or Firm*—Foley & Lardner Schwartz, Jeffery, Schwaab, Mack, Blumenthal & Evans

[57] ABSTRACT

A ceramic rocker arm is hollow and formed with two openings for providing communication between an inner hollow place and the outside of the rocker arm. The inner hollow place is communicated with a source of lubricant. The openings are located adjacent surface portions of the rocker arm contacting a cam and a valve so that lubricant is supplied through the inner hollow place and the openings to the joints between the rocker arm and the respective cam and valve. A filler of a synthetic resinous material is filled in the hollow ceramic rocker arm so as to prevent dispersion of small pieces upon breakage of the rocker arm.

8 Claims, 2 Drawing Sheets

ROCKER ARM MADE OF CERAMICS

BACKGROUND OF THE INVENTION

I. Field of the Invention

The present invention relates to improvements in or relating to a rocker arm made of ceramics for an internal combustion engine.

II. Description of the Prior Art

Various improvements relating to an internal combustion engine, particularly to its valve drive mechanism have recently been proposed in order to attain a high output and an easy maintenance. For example, a rocker arm entirely made of ceramics or a rocker arm having at its sliding portion a ceramic tip which is embedded in an aluminum main body upon casting has been proposed in order to improve the wear resistivity or durability of the rocker arm used at high engine revolution.

A disadvantage of the rocker arm entirely made of ceramics is that it is liable to be broken when subjected to an excessively large impact load at over-revolution of the engine. When the rocker arm is broken, small pieces of the broken rocker arm intrude into the engine to cause serious damage of same.

Another disadvantage is that when the rocker arm is improved in wear resistivity in the above manner, the wear of the cam is increased considerably.

A disadvantage of the rocker arm provided with the ceramic tip is that it requires a particular treatment at the joint between the ceramic tip and the metal main body, thus increasing the cost.

Another disadvantage of the rocker arm provided with the ceramic tip is that its most largely movable portion is heavy, i.e., has a large inertia mass.

SUMMARY OF THE INVENTION

In accordance with the present invention, there is provided an improved ceramic rocker arm made of ceramics and formed into a single piece. The rocker arm comprises a cavity, a sliding surface portion and an opening providing communication between the cavity and the outside of the rocker arm.

In one aspect of the present invention, the cavity is communicated with a source of lubricant so that lubricant is supplied through the cavity and the opening to the joint between the rocker arm and a cooperating cam or valve.

In another aspect of the present invention, a filler of a synthetic resinous material is filled in the hollow ceramic rocker arm so as to prevent dispersion of broken pieces upon breakage.

The above rocker arm is effective for solving the above noted problems inherent in the prior art rocker arm.

It is accordingly an object of the present invention to provide an improved ceramic rocker arm for an internal combustion engine which can improve the wear resistivities or durabilities of the associated cam and valve as well as the wear resistivity or durability of itself.

It is another object of the present invention to provide an improved ceramic rocker arm of the above described character which can prevent the engine from being damaged seriously upon breakage of the rocker arm.

It is a further object of the present invention to provide an improved ceramic rocker arm of the above described character which can reduce the inertia mass of its most largely movable portion and thereby attain a higher output of the engine.

It is a further object of the present invention to provide an improved ceramic rocker arm of the above described character which can make easier the engine maintenance.

DESCRIPTION OF THE PREFERRED EMBODIMENTS

Figure 1:
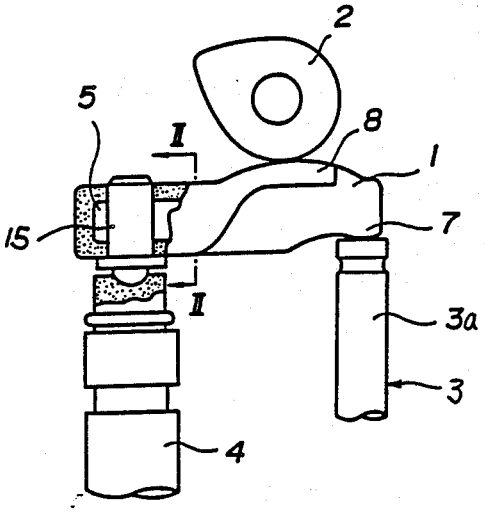
FIG. 1 is an elevational, partly sectioned view of a valve drive mechanism incorporating a rocker arm according to an embodiment of the present invention.
Figure 2:
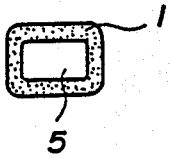
FIG. 2 is a sectional view taken along the line II—II of FIG. 1.
Figure 3:
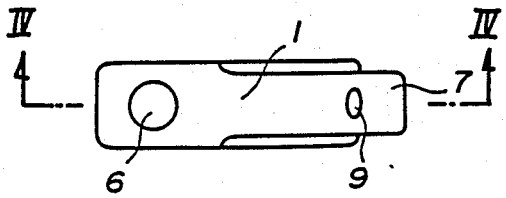
FIG. 3 is a bottom plan view of the rocker arm of FIG. 1.
Figure 4:
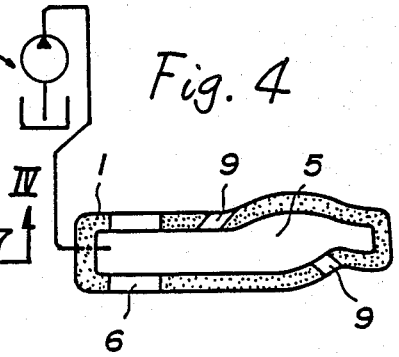
FIG. 4 is a sectional view taken along the line IV—IV of FIG. 3.

Referring to FIGS. 1 to 4, a rocker arm according to an embodiment of the present invention is generally indicated by the reference numeral 1. The rocker arm 1 is entirely made of ceramics, e.g., a material containing silicon nitride as a main substance and formed with an inner hollow section or cavity 5. The rocker arm 1 is also formed with two openings 9 and 9 adjacent a surface portion 7 in contact with an end of a valve stem 3*a* of a valve 3 and a surface portion 8 in contact with a cam 2. The two openings 9 and 9 are communicated with the cavity 5, i.e., so formed as to provide communication between the cavity 5 and the outside of the rocker arm 1. A source 14 of lubricant under pressure is communicated with the cavity 5 so as to supply lubricant thereto.

With the above structure, the cam 2 rotates while being held in contact with the cam contacting surface portion 8 of the rocker arm 1. Rotation of the cam 2 causes the rocker arm 2 to swing about a pivot 15. The valve contacting surface portion 7 of the rocker arm 1 is held in contact with the end of the valve stem 3*a* so as to move in unison. The valve 3 moves to and fro in response to movement of the rocker arm 2. In this instance, lubricant is introduced from the source 14 to the rocker arm 1 and conducted through the cavity 5 and the openings 9 and 9 to the joint between the cam contacting surface portion 8 and the cam 2 and to the joint between the valve contacting surface portion 7 and the valve stem 3*a* of the valve 3 to lubricate the same. The lubricant having lubricated the above described joints is returned to an oil pan (not shown) in the conventional manner.

Experiments were conducted with the hollow rocker arm of this invention and a comparable solid rocker arm (i.e., a rocker arm having no lubrication means) in order to test their wear resistivities. A 2-liter four cylinder internal combustion engine was used and operated for the test for continuous 100 hours with a fully open throttle valve. The experimental result is that the wear of the hollow rocker arm of this invention is 3 μm whereas the wear of the solid rocker arm for comparison is 10 μm. By the experiments, it is proved that the present invention is effective for improving the wear resistivity or durability of the rocker arm.

Figure 5:
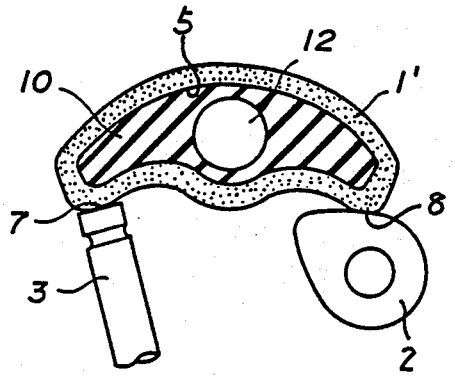
FIG. 5 is an elevational, partly sectioned view of a valve drive mechanism incorporating a rocker arm according to another embodiment.

FIG. 5 shows another embodiment of the present invention in which parts and portions like or corresponding to those of the previous embodiment of FIGS. 1 to 4 are designated by the same reference numerals. In this embodiment, a rocker arm 1' has a cavity 5 filled with a synthetic resinous material as for example chloroprene, silicon rubber, fluorocarbon resin, adhesive containing silicon rubber as a main substance, adhesive containing synthetic rubber as a main substance, etc. The rocker arm 1' has fitted therein a rocker shaft 12 at a location intermediate between the valve contacting portion 7 and the cam contacting surface portion 8.

Experiments were conducted with the rocker arm 1' of FIG. 5 in order to test how the rocker arm 1' disperses its broken pieces. When an excessively large load was applied to the cam contacting surface portion 8 to break the rocker arm 1' which was supported at the rocker shaft 12, it was found that the rocker arm 1' did not substantially disperse its broken pieces.

Figure 6:
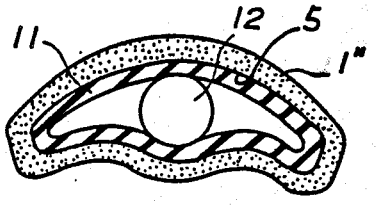
FIG. 6 is a sectional view of a rocker arm according to a further embodiment of the present invention.

FIG. 6 shows a further embodiment of the present invention which differs from the previous embodiment of FIG. 5 in that the cavity 5 of the rocker arm 1'' is filled with a synthetic resinous material in such a way that the inner wall of the rocker arm 1'' defining the cavity 5 is covered with a layer of a synthetic resinous material. With this structure, this embodiment can produce substantially the same effect as the previous embodiment of FIG. 5.

In the meantime, indicated by the reference numeral 4 is a lash adjuster for eliminating the lash or clearance between the valve contacting portion 7 of the rocker arm 1 and the end of the valve stem 3*a*, and by 6 are openings in which the pivot 13 for contact with the lash adjuster 4 is fitted.

Figure 7:
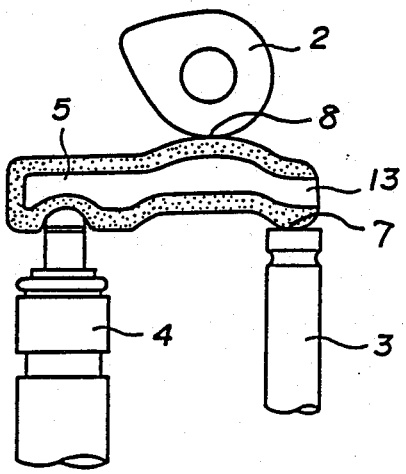
FIG. 7 is a view similar to FIG. 1 but showing a rocker arm according to a further embodiment of the present invention.

FIG. 7 shows a further embodiment of the present invention in which parts and portions like or corresponding to those of the previous embodiment of FIGS. 1 to 4 are designated by the same reference numerals. In this embodiment, the rocker arm 1 is formed with an opening 13 at an end portion which swings or moves more largely than any other portions of the rocker arm 1. By the experiments, it is found that the rocker arm 1 of this embodiment makes it possible to increase the maximum engine speed by 5%. This embodiment is therefore effective for improving the high speed operation of the valve drive train and thereby attaining the high output of the engine.

While the above three embodiments are illustrated separately, they may be combined with each other or all together to produce combinations of the effects.

What is claimed is:

1. A rocker arm made of ceramics and formed into a single piece, comprising:
- a cavity;
- a sliding surface portion; and
- an opening providing communication between said cavity and the outside of said rocker arm.

2. An internal combustion engine comprising:
- a rocker arm made of ceramics and formed into a single piece;
- a cam for driving said rocker arm;
- a valve driven by said rocker arm;
- said rocker arm having a cavity and two openings providing communication between said cavity and the outside of said rocker arm;
- said two openings being located adjacent surface portions of said rocker arm contacting said cam and said valve, respectively; an
- a source of lubricant communicated with said cavity.

3. A rocker arm made of ceramics and formed into a single piece, comprising:
- a cavity; and
- a filler of a synthetic resinous material filling said cavity.

4. A rocker arm made of ceramics and formed into a single piece, comprising:
- an inner wall defining a cavity; and
- a layer of a synthetic resinous material covering said inner wall.

5. The rocker arm according to claim 3 wherein said synthetic resinous material is one of chloroprene, silicon rubber, fluorocarbon resin, adhesive containing silicon rubber as a main substance and adhesive containing synthetic rubber as a main substance.

6. The rocker arm according to claim 1 wherein said opening is formed in a portion movable more largely than any other portions.

7. A rocker arm made of ceramics and formed into a single piece, comprising:
- a cavity;
- a portion movable more largely than any other portions; and
- an opening formed in said largely movable portion.

8. The rocker arm according to claim 4 wherein said synthetic resinous material is one of chloroprene, silicon rubber, fluorocarbon resin, adhesive containing silicon rubber as a main substance and adhesive containing synthetic rubber as a main substance.

* * * * *